US007121749B2

(12) United States Patent
Morikawa et al.

(10) Patent No.: US 7,121,749 B2
(45) Date of Patent: Oct. 17, 2006

(54) DEVICE AND METHOD FOR CARRIAGE DRIVE CONTROL

(75) Inventors: Jun Morikawa, Nagoya (JP); Kazushige Muroi, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/176,192

(22) Filed: Jul. 8, 2005

(65) Prior Publication Data

US 2006/0008310 A1 Jan. 12, 2006

(30) Foreign Application Priority Data

Jul. 9, 2004 (JP) ..... 2004-203168

(51) Int. Cl.
*B41J 19/00* (2006.01)

(52) U.S. Cl. ..... 400/283; 400/284; 318/560

(58) Field of Classification Search ..... 400/279, 400/283, 284, 294, 124.05; 347/5, 14, 19, 347/37; 318/560, 567, 568.17, 568.18, 286, 318/366, 369

See application file for complete search history.

(56) References Cited

U.S. PATENT DOCUMENTS 6,600,286 B1 * 7/2003 Tanaka et al. ..... 318/560
6,756,760 B1 * 6/2004 Tanaka et al. ..... 318/560
6,809,489 B1 * 10/2004 Yoshida et al. ..... 318/560
2005/0189895 A1 * 9/2005 Muroi ..... 318/376

FOREIGN PATENT DOCUMENTS

JP 2001-310517 11/2001
JP 2003-335011 11/2003

* cited by examiner

*Primary Examiner*—Minh Chau
(74) *Attorney, Agent, or Firm*—Banner & Witcoff, Ltd.

(57) ABSTRACT

A carriage drive control device is provided which moves a carriage at a constant speed in a recording area for recording operation and which moves the carriage to a target stop position in a better way for non-recording operation. A controlled variable of actuator is calculated based on a speed error between a target speed and a moving speed of the carriage. The target speed is set based on a position error between the target stop position and a current position of the carriage, and is not more than a predetermined first speed. When the actuator starts moving the carriage for recording operation, a control rule used for calculation of the controlled is set to a first control rule, and when the actuator starts moving the carriage for non-recording operation, the control rule is set to a second control rule.

13 Claims, 12 Drawing Sheets

DEVICE AND METHOD FOR CARRIAGE DRIVE CONTROL

CROSS-REFERENCE TO RELATED APPLICATIONS

This application claims the benefit of Japanese Patent Application No. 2004-203168 filed Jul. 9, 2004 in the Japan Patent Office, the disclosure of which is incorporated herein by reference.

BACKGROUND

This invention relates to a device and method for carriage drive control in an image forming apparatus that forms an image on a recording medium by moving a carriage which mounts a recording head thereon in a main scanning direction. The device and method for carriage drive control is used in moving the carriage in the main scanning direction.

Conventionally, a known image forming apparatus moves a recording sheet in a sub-scanning direction while a carriage which mounts a recording head thereon is moved in a main scanning direction, so that an image is formed on the recording sheet.

In this type of the image forming apparatus, it is necessary to move the recording head (and the carriage) at a constant speed when the recording head is operated to form an image on the recording sheet. Therefore, as shown in FIG. 11, the conventional carriage drive control device accelerates the carriage, per scanning of the carriage, from a stop position (driving start position) so that the moving speed of the carriage goes up to a constant target speed Vt at a recording start position Xs where the recording operation by the recording head is started. When the carriage reaches the recording start position Xs, the carriage is moved at the constant target speed Vt till a recording termination position Xe where the recoding operation by the recording head is ended. When the carriage reaches the recording termination position Xe, the carriage is decelerated, and stopped at a stop position (target stop position) Xt from which the carriage can be accelerated to the constant target speed before reaching the recording start position at the next scanning.

SUMMARY

As above, in the conventional carriage drive control device, in order to move the carriage at a constant speed (constant target speed) in. A recording area by the recording head, three sections, that is, an acceleration section between the driving start position where the carriage is stopped and the recording start position Xs, a constant-speed section between the recording start position Xs and the recording termination position Xe, and a deceleration section between the recording termination position Xe and the target stop position Xt, are provided for carriage drive control. Such a control rule for carriage drive control is also used just for moving the carriage without operating the recording head, such as for moving the carriage to a maintenance area for maintenance of the recording head.

It would be desirable to provide a carriage drive control device that can move a carriage at a constant speed in a recording section when a recording head is operated to perform recording to a recording medium, and that can move the carriage to the target stop position in a better way when simply the carriage is moved.

One aspect of the present invention provides a carriage drive control device in an image forming apparatus that forms an image on a recording medium by moving the recording medium in a sub-scanning direction and moving the carriage which mounts a recording head thereon in a main scanning direction. The carriage drive control device moves the carriage in the main scanning direction, and includes an actuator, a detector, a position controller, a speed controller, a driving unit, and a speed control switcher. The actuator moves the carriage to and fro in the main scanning direction. The detector detects a position and a moving speed of the carriage. The position controller sets a target speed based on a position error between a target stop position and a current position of the carriage detected by the detector. The target speed is not more than a predetermined first speed. The speed controller calculates a controlled variable of the actuator based on a speed error between the target speed set by the position controller and the moving speed of the carriage detected by the detector. The driving unit drives the actuator according to the controlled variable calculated by the speed controller. The speed control switcher sets a control rule used for calculation of the controlled variable by the speed controller. When the actuator starts moving the carriage for recording operation, the speed control switcher sets a first control rule, and when the actuator starts moving the carriage for non-recording operation, the speed control switcher sets a second control rule.

BRIEF DESCRIPTION OF THE DRAWINGS

The invention will now be described below, by way of example, with reference to the accompanying drawings, in which.

DETAILED DESCRIPTION OF THE PREFERRED EMBODIMENT

Figure 1:
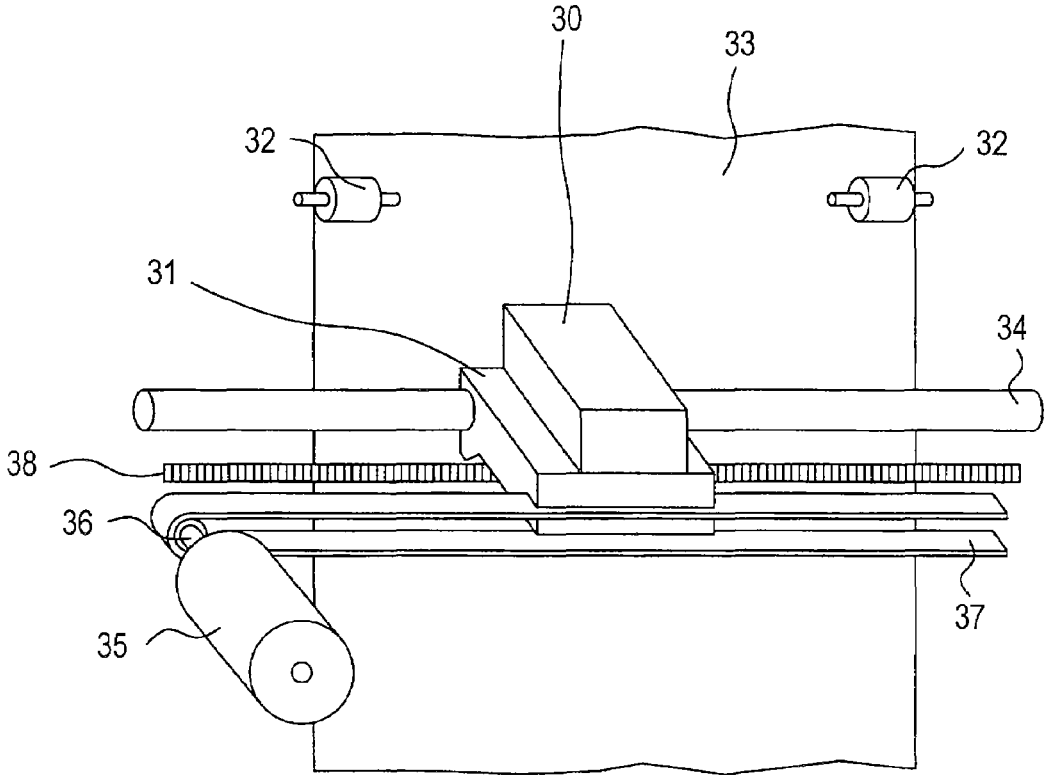
FIG. 1 is a schematic structural view of a carriage drive mechanism as a component of a printer according to an embodiment of the present invention.

Referring to FIG. 1, an ink jet printer (hereafter, referred to as a "printer") comprises a carriage drive mechanism according to the present invention. In this carriage drive mechanism, a recording head 30 is mounted on a carriage 31, and hold rollers 32 convey a recording sheet 33. The recording head 30 performs recording by ejecting ink toward the recording sheet 33 from a nozzle. A guide shaft 34 provided in a width direction of the recording sheet 33 is passed through the carriage 31.

A CR motor 35 is provided on one end of the guide shaft 34. Between a pulley 36 of the CR motor 35 and an idle pulley (not shown) provided on the other end of the guide shaft 34, an endless belt 37 is held along the guide shaft 34. The carriage 31 is connected to the endless belt 37.

That is, the carriage 31 is designed to move back and forth in a width direction of the recording sheet 33 along the guide shaft 34 by a driving force of the CR motor 35 transmitted via the endless belt 37.

A timing slit 38 is provided below and along the guide shaft 34. Slits having a certain interval therebetween (1/150 inches=approximately 0.17 mm, in the present embodiment) are formed on the timing slit 38.

A detector (not shown) is provided in a lower part of the carriage 31. The detector includes a photo interrupter having a light emitting element and a light receiving element arranged to face each other. The timing slit 38 is positioned between the light emitting element and the light receiving element. The detector and the timing slit 38 together constitute a later-explained linear encoder 39 (see FIG. 3).

Figure 2:
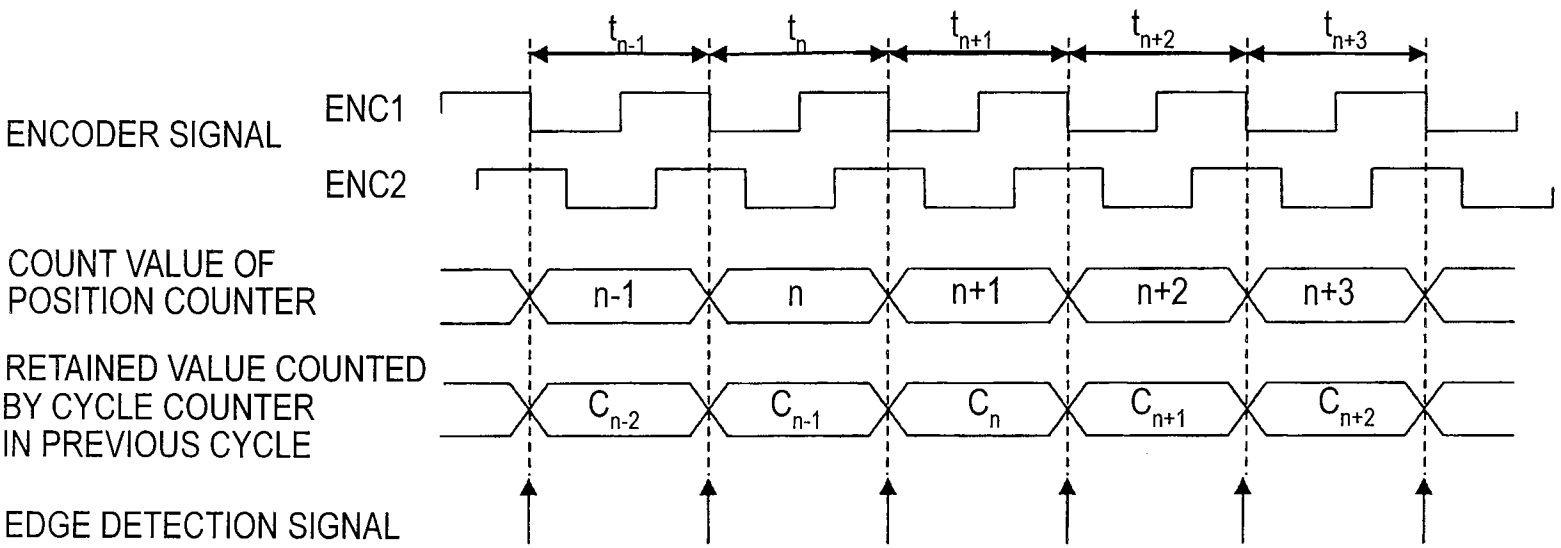
FIG. 2 is a diagram illustrating encoder signal, and a process operation of a carriage positioning unit that processes the signal.

As shown in FIG. 2, the detector constituting the linear encoder 39 outputs two types of encoder signal, ENC1 and ENC 2. The phase of ENC1 and the phase of ENC2 are shifted by a predetermined cycle (¼ cycles, in the present embodiment). When the carriage 31 is moved in a forward direction, that is, from a home position (the left end position in FIG. 1) to the side of the idle pulley, the phase of ENC 1 is advanced ahead of the phase of ENC2 by the predetermined cycle. When the carriage is moved in a reverse direction, that is, from the side of the idle pulley to the home position, the phase of ENC1 is delayed from the phase of ENC2 by the predetermined cycle.

Figure 11:
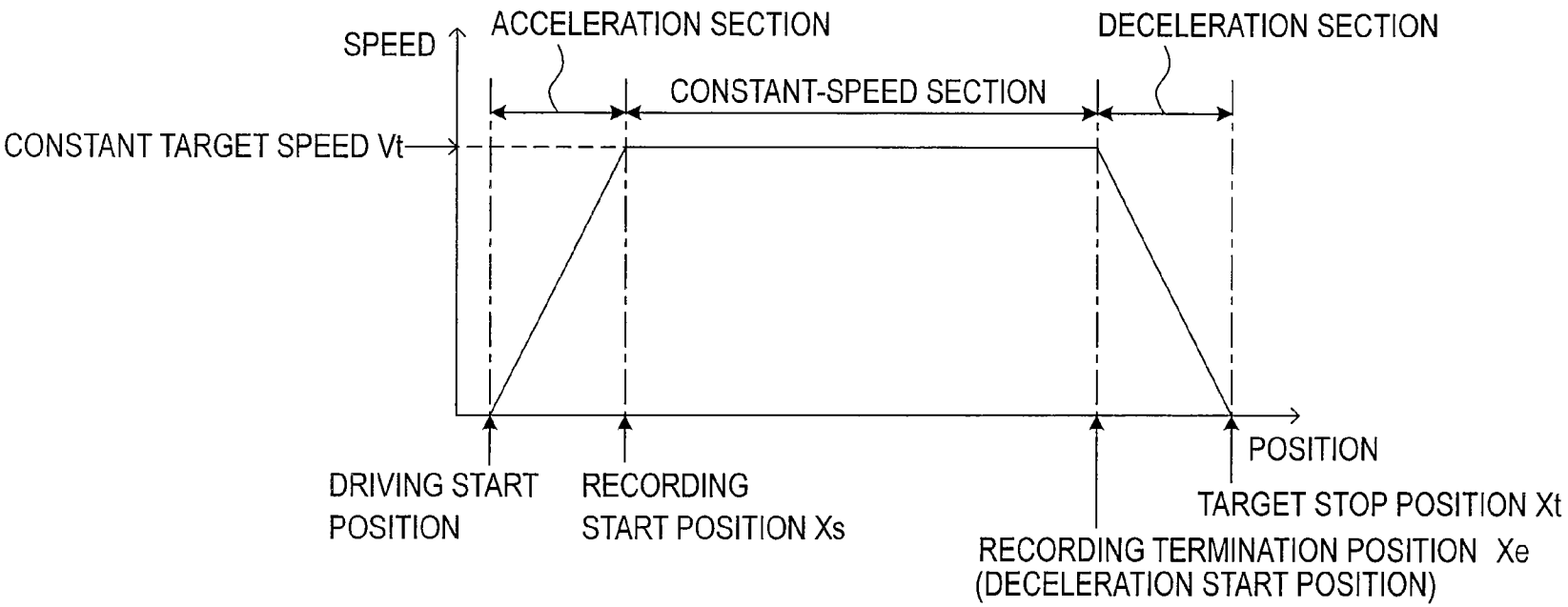
FIG. 11 is a diagram illustrating a general outline of conventional carriage control.

In the above carriage drive mechanism, the carriage 31 is stopped at the home position near a side end of the pulley 35 of the guide shaft 34, at a position where the last recording is terminated, or at a predetermined stop position for maintenance, etc. of the recording head 30. As shown in FIG. 11, when the recording head 30 is operated to start the recording process for forming an image on the recording sheet 33, the carriage 31 is accelerated so as to reach a constant target speed Vt before arriving at a recording start position Xs from a driving start position (i.e., stop position). Then, the carriage 31 is moved at a constant target speed Vt till it reaches a recording termination position Xe. After passing the recording termination position Xe, the carriage 31 is decelerated until it is stopped.

In order to move the carriage 31 as above, a carriage drive control device is provided in the printer.

Figure 3:
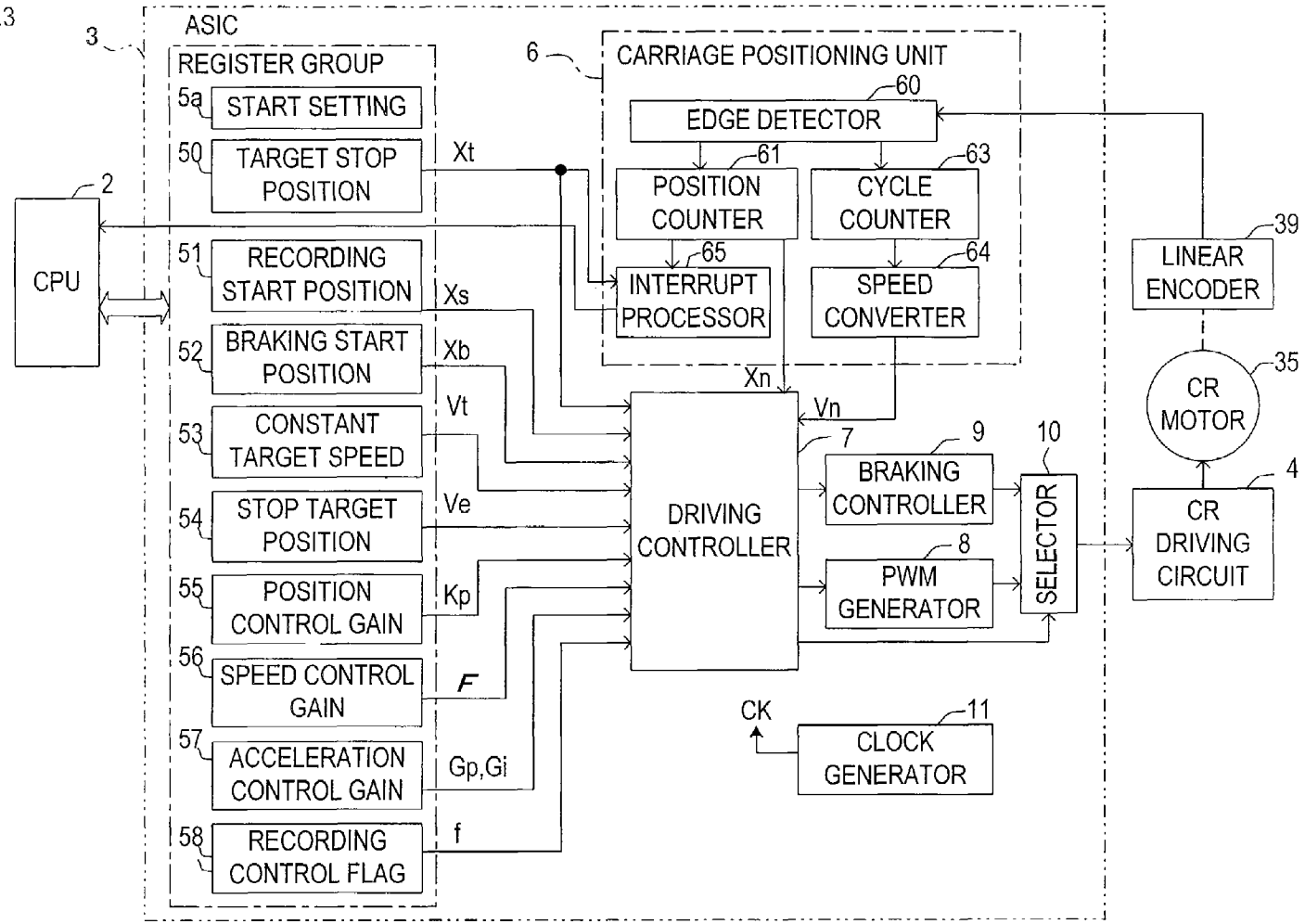
FIG. 3 is a block diagram showing a structure of a control device (ASIC) that drives and controls a carriage.

As seen in FIG. 3, the carriage drive control device is for driving the CR motor 35 which actuates the carriage 31 in response to instructions from a CPU 2 that controls the overall printer. The carriage drive control device comprises an ASIC (Application Specific Integrated Circuit) 3 and a motor driving circuit (hereafter, referred to as CR driving circuit) 4. The ASIC 3 generates PWM (Pulse Width Modulation) signal for controlling a rotation speed and rotation direction of the CR motor 35, and braking signal for generating a braking force in the CR motor 35 to stop the carriage 31. The CR driving circuit 4 drives or stops the CR motor 35 based on the PWM signal or the braking signal generated in the ASIC 3.

Figure 4:
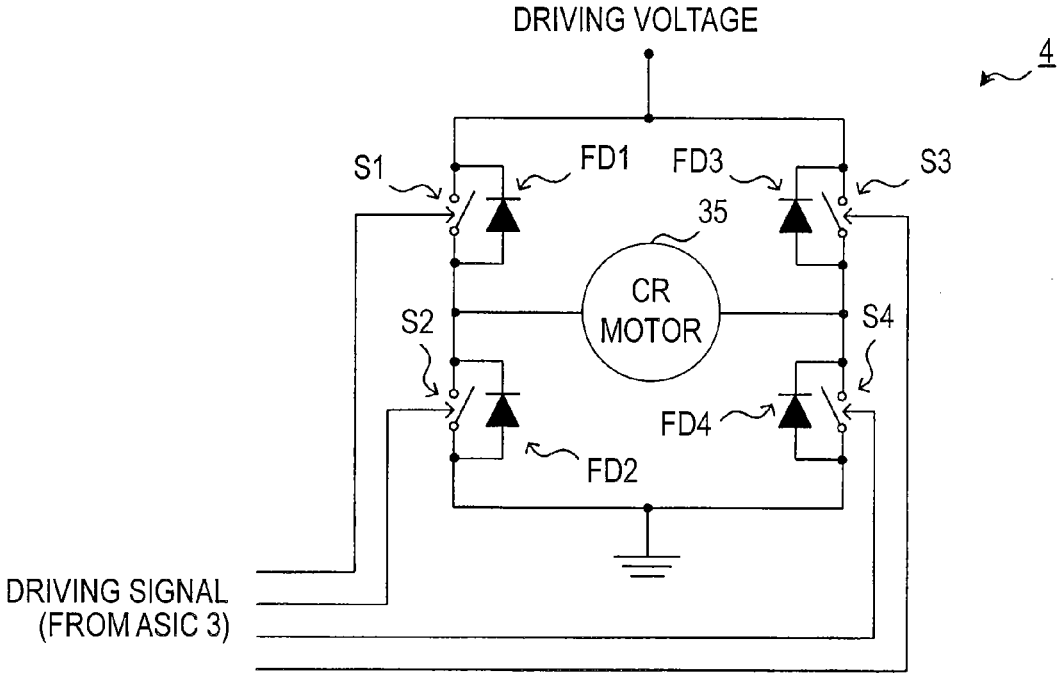
FIG. 4 is a circuit diagram showing a structure of a carriage drive circuit shown in FIG. 3.

Referring to FIG. 4, the CR driving circuit 4 is an H-bridge circuit including four switching elements (e.g., FET: Field-Effect Transistors) S1 to S4 and four flywheel diodes FD1 to FD4 which are connected in parallel to the respective switching elements. The CR driving circuit 4 turns on/off the switching elements S1 to S4 in response to external signal (PWM signal and braking signal) so as to control current to the CR motor 35.

That is, the CR driving circuit 4, for example, can rotate the CR motor 35 in a forward direction by turning off the switching elements S3 and S2, turning on the switching element S1, and turning on/off the switching element S4 by the PWM signal, so as to move the carriage 31 in a single direction. Contrary, the CR driving circuit 4 can rotate the CR motor 35 in a reverse direction by turning off the switching elements S1 and S4, turning on the switching element S3, and turning on/off the switching element S2 by the PWM signal, so as to move the carriage 31 in multiple directions.

When all the switching elements S1 to S4 are turned off while the CR motor 35 is being rotated as above, current is passed to the CR motor 35 through the flywheel diodes FD2 and FD3 or FD4 and FD1, in the same direction as when the motor is driven, due to energy accumulated in the motor winding inside the CR motor 35. The energy accumulated in the motor winding is returned to the side of a direct-current power source which supplies a driving voltage. Owing to the regenerative operation of the energy, a braking force (regenerative brake) is generated in the CR motor 35, and the CR motor 35 and the carriage 31 are promptly stopped.

The ASIC 3 comprises a register group 5 that stores various parameters for use in controlling the CR motor 35. The ASIC 3 further comprises a carriage positioning unit 6, a drive controller 7, a PWM generator 8, a braking controller 9, a selector 10, and a clock generator 11. The carriage positioning unit 6 calculates the position and the moving speed of the carriage 31 according to the encoder signals ENC1 and ENC2 received from the linear encoder 39. The drive controller 7 generates instruction signal for controlling the CR motor 35 to drive or stop the carriage 31. The PWM generator 8 generates PWM signal for driving the CR motor 35 at duty ratio according to drive instructions (particularly, the drive voltage of the CR motor 35) from the drive controller 7. The braking controller 9 generates braking signal for braking the carriage 31 in response to brake instructions from the drive controller 7. The selector 10 selectively outputs the PWM signal generated by the PWM generator 8 or the braking signal generated by the braking controller 9 according to selection instructions from the driving controller 7. The clock generator 11 supplies clock signal CK having a cycle sufficiently shorter than the cycle of the encoder signals ENC1 and ENC2, to each part of the ASIC 3.

The register group 5 includes a start setting register 5*a* that is used to start the CR motor 35, and registers 50 to 58 described in (a) to (i) below:

(a) the register 50 that is used to set a target stop position Xt where the carriage 31 should be stopped;

(b) the register 51 that is used to set a recording start position Xs where recording to the recording sheet 33 should be started by the recording head 51;

(c) the register 52 that is used to set a braking start position Xb where braking of the carriage is started;

(d) the register 53 that is used to set a constant target speed Vt which is the target speed when the carriage 31 is moved in a constant speed;

(e) the register 54 that is used to set a stop target speed Ve when generating a braking force in the CR motor 35 to stop the carriage 31;

(f) the register 56 that is used to set a position control gain Kp required to calculate a control target speed Vo (see FIG. 5) when moving the carriage 31;

(g) the register 56 that is used to set a speed control gain [F] required for calculating a driving voltage which is a controlled variable necessary to move the carriage 31 at the control target speed Vo;

(h) the register 57 that is used to set two acceleration control gains (proportional gain Gp and integral gain Gi) required to accelerate the carriage 31 so as not to exceed the aforementioned constant target speed Vt when moving the carriage 31 for image formation on the recording sheet 33; and (i) the register 58 that is used to set a recording control flag f indicating whether to operate the recording head 30 to form an image on the recording sheet 33 or simply move the carriage 31 without operation of the recording head 30, at the time of moving the carriage 31.

The carriage positioning unit 6 includes an edge detector 60, a position counter 61, a cycle counter 63, a speed converter 64, and an interrupt processor 65. The edge detector 60 detects edge detection signal (particularly, an edge of ENC1 when ENC2 is at a high level) indicating the start/end of each cycle of the encoder signal ENC1 based on the encoder signals ENC1 and ENC2 from the linear encoder 39, and the rotation direction of the CR motor 35 (the forward direction if the edge detection signal is a leading edge of ENC1, and the reverse direction if the edge detection signal is a falling edge of ENC1). The position counter 61 detects which slit from the home position the carriage 31 is located by, according to the rotation direction of the CR motor 35 (i.e., the moving direction of the carriage 31) detected by the edge detector 60, incrementing (in the case of the forward direction) or decrementing (in the case of the reverse direction) the number of the edge detection signal. The cycle counter 63 counts the interval between the edge detection signals from the edge detector 60 by counting the clock signal CK. The speed converter 64 calculates the moving speed (actual speed) Vn of the carriage 31, based on the distance (1/150 inches) between the slits of the timing slit 38 and a time period $t_{n-1}$ ($=C_{n-1}\times$clock cycle) specified by a retained value $C_{n-1}$ which is a value counted by the cycle counter 63 in the previous cycle of the encoder signal ENC1. The interrupt processor 65 outputs stop interrupt signal to the CPU 2 according to a count value of the position counter 61.

The interrupt processor 65 outputs the stop interrupt signal to the CPU 2 when the count value of the position counter 61 is not less than the target stop position Xt set in the register 51.

Figure 5:
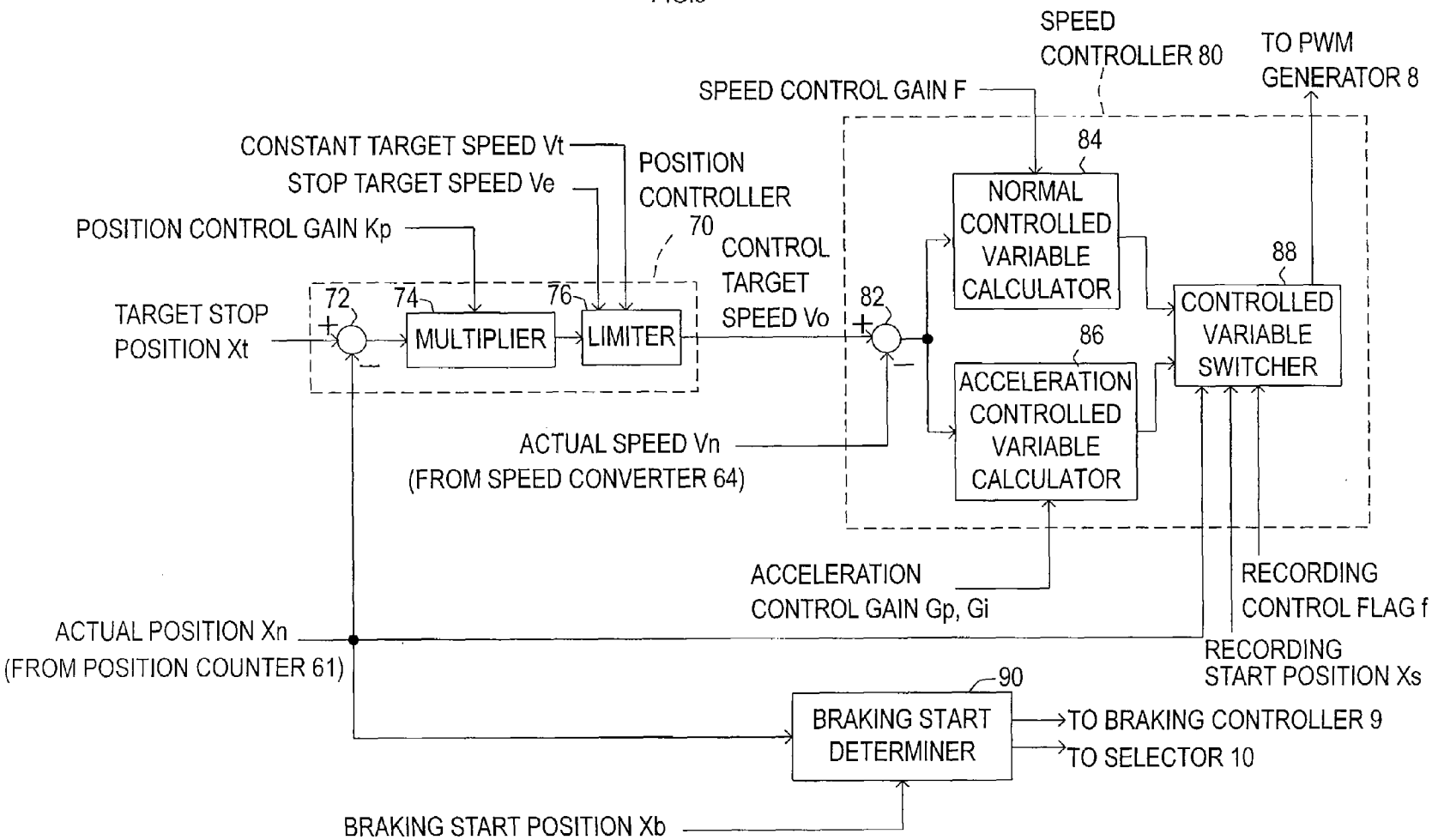
FIG. 5 is a block diagram showing a structure (feature) of a drive controller shown in FIG. 3.

The drive controller 7, as shown in FIG. 5, includes a position controller 70, a speed controller 80, and a braking start determiner 90. The position controller 70 calculates the control target speed Vo, based on an error (position error) ΔX between the target stop position Xt set in the register 51 and the current position (actual position) Xn of the carriage 31 defined by the count value of the position counter 61. The speed controller 80 calculates the controlled variable (the driving voltage of the CR motor 35) for controlling the actual speed Vn of the carriage 31 obtained in the speed converter 64 to the control target speed Vo obtained by the position controller 70. The braking start determiner 90 determines whether the actual position Xn of the carriage 31 defined by the count value of the position counter 61 has reached the braking start position Xb set in the register 52 at the time of deceleration of the carriage 31, and when determines that the actual position Xn has reached the braking start position Xb, operates the braking controller 9 in order to generate a braking force in the CR motor 35 and select the braking signal from the braking controller 9 through the selector 10.

Figure 6:
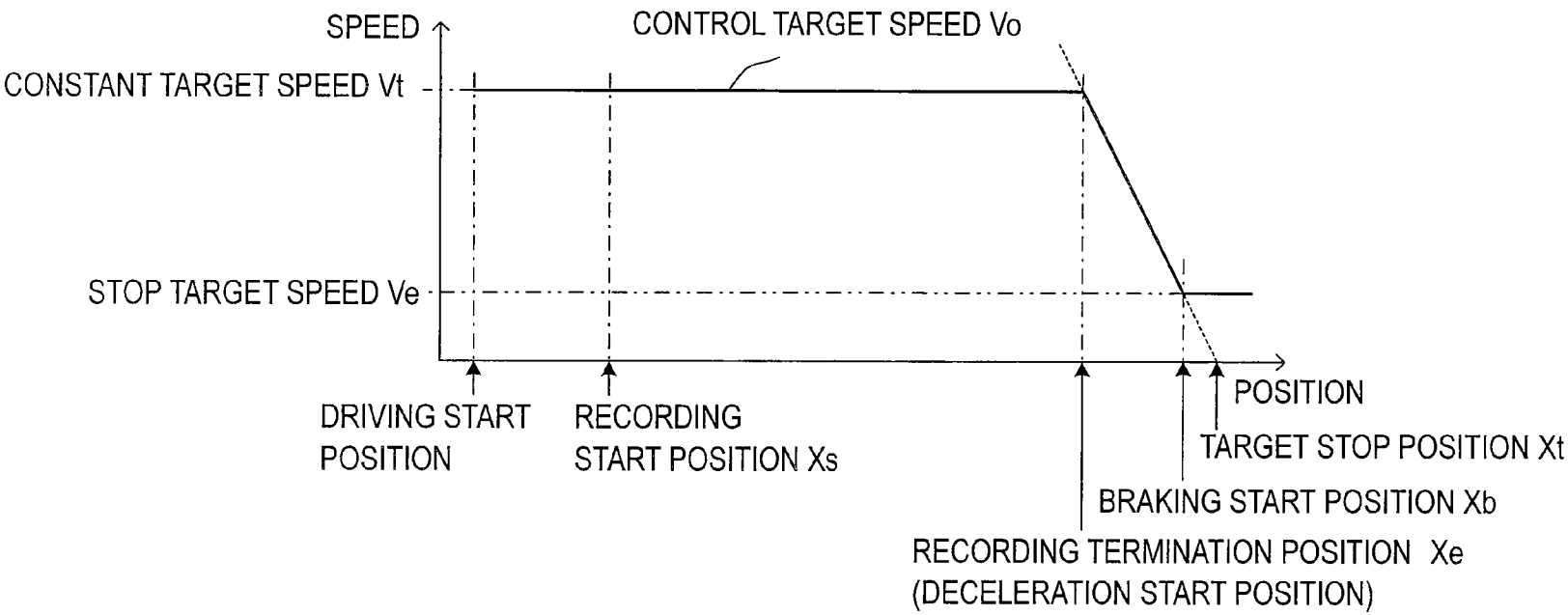
FIG. 6 is a diagram illustrating a control target speed outputted from a position controller of FIG. 5.

The position controller 70 includes a subtracter 72, a multiplier 74, and a limiter 76. The subtracter 72 calculates the position error ΔX between the target stop position Xt and the actual position Xn. The multiplier 74 calculates the control target speed Vo proportional to the position error ΔX by multiplying the positional error ΔX calculated in the subtracter 72 by the position control gain Kp for proportional control (P control) set in the register 55. The limiter 76 limits the maximum of the control target speed Vo calculated in the multiplier 74 to the constant target speed Vt set in the register 53 as well as limits the minimum of the control target speed Vo to the stop target speed Ve set in the register 54, so as to set the control target speed Vo inputted to the speed controller 80 as shown in FIG. 6.

The speed controller 80 includes a subtracter 82, a normal controlled variable calculator 84, an acceleration controlled variable calculator 86, and a controlled variable switcher 88. The subtracter 82 calculates a speed error ΔV between the control target speed Vo set by the position controller 70 and the actual speed Vn. The normal controlled variable calculator 84 calculates the controlled variable (the driving voltage of the CR motor 35) based on the speed error ΔV obtained in the subtracter 82 and the speed control gain [F] set in the register 56. The acceleration controlled variable calculator 86 calculates the controlled variable (the driving voltage of the CR motor 35) based on the speed error ΔV and the speed control gain (proportional gain Gp and integral gain Gi) set in the register 57. The controlled variable switcher 88 switches the controlled variable (the driving voltage of the CR motor 35) outputted to the PWM generator 8 to one of the controlled variables calculated in the normal controlled variable calculator 84 and acceleration controlled variable calculator 86, based on the recording control flag f set in the register 58, the recording start position Xs set in the register 51, and the actual position Xn of the carriage 31.

The normal controlled variable calculator 84 is designed to generate a state equation (1) and an output equation (2) shown below, which describe the behavior of the driving system of the carriage 31, using the known system identification method, etc., and set the speed control gain [F] according to a known design method based on the modern control theory. Specifically in the present embodiment, for the purpose of giving priority to control responsiveness, the normal controlled variable calculator 84 is designed so as to follow the control rule for implementation of known robust control. The details for the design method for robust control systems are described in "Control system design—H∞ control and application thereof", edited by Shigeyuki HOSOE and Mitsuhiko ARAKI, ISCIE, Asakura Shoten (ISBN4254209703, published Jun. 1, 1994), for example, and thus, explanation on the same is omitted.

$$x_{(t+1)}=A\cdot x_{(t)}+B\cdot u_{(t)} \tag{1}$$

$$y_{(t)}=C\cdot x_{(t)}+D\cdot u_{(t)} \tag{2}$$

The controlled variable switcher 88, when "1" is set to the recording control flag f in the register 58 (f=1), selects and outputs the controlled variable obtained in the acceleration controlled variable calculator 86 to the PWM generator 8 until the actual position Xn of the carriage 31 reaches the recording start position Xs set in the register 51 after starting the CR motor 35. Otherwise, that is, when the recording control flag f is reset (f=0) or even if "1" is set to the recording control flag f (f=1) but the actual position Xn of the carriage has passed the recording start position Xs, the controlled variable switcher 88 selects and outputs the controlled variable obtained in the normal controlled variable calculator 84 to the PWM generator 8.

The control rule implemented by the acceleration controlled variable calculator 86 is based on a proportional-integral control (PI control) system using the proportional gain Gp and integral gain Gi. These acceleration control gains Gp and Gi are set to be less sensitive to the speed error ΔX than in the robust control system implemented in the normal controlled variable calculator 84, placing emphasis on control stability. This is to prevent the actual speed Vn of the carriage 31 from overshooting the constant target speed Vt at the time of acceleration of the CR motor 35.

Figure 7:
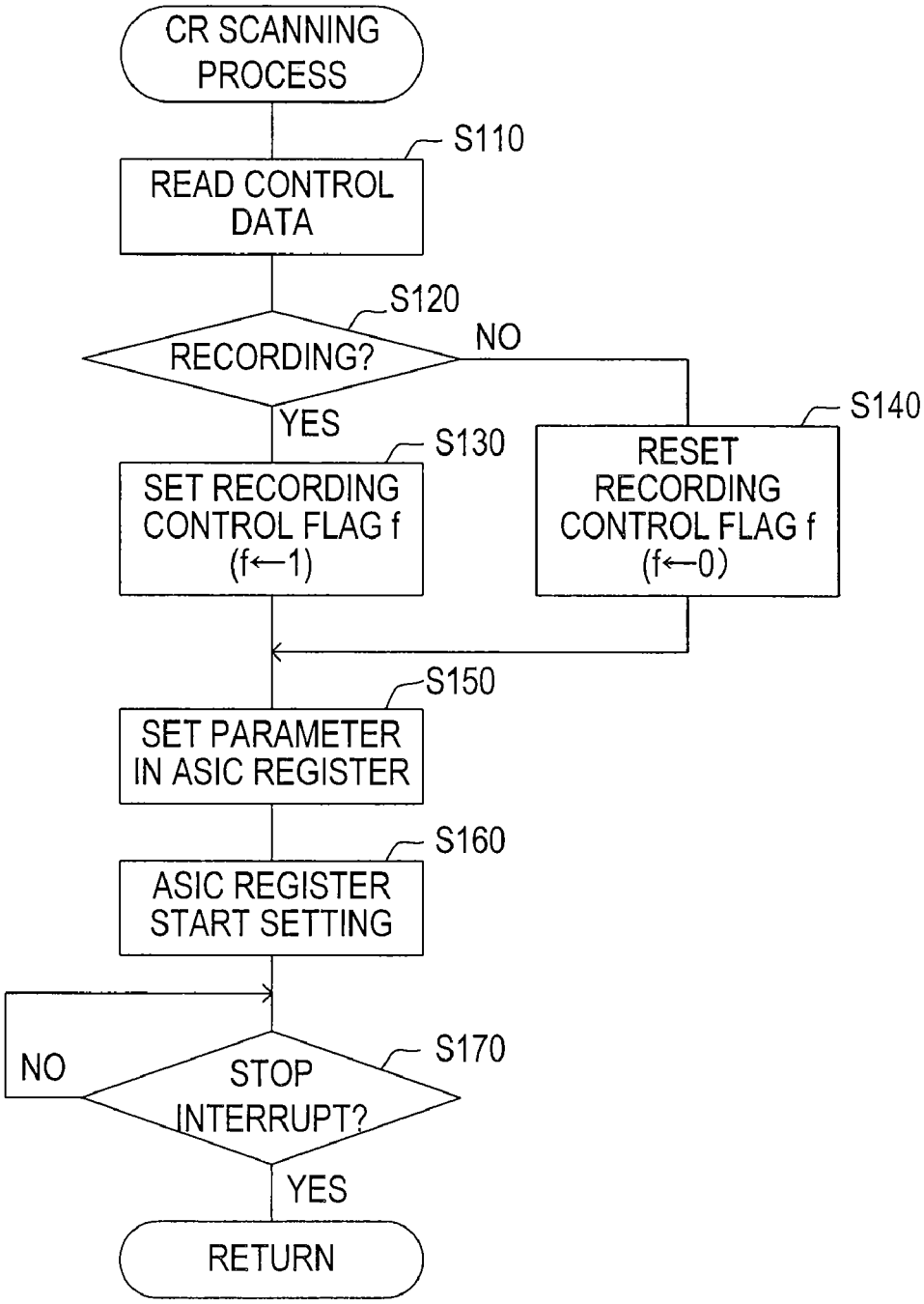
FIG. 7 is a flowchart showing a carriage scanning process executed by a CPU.
Figure 8:
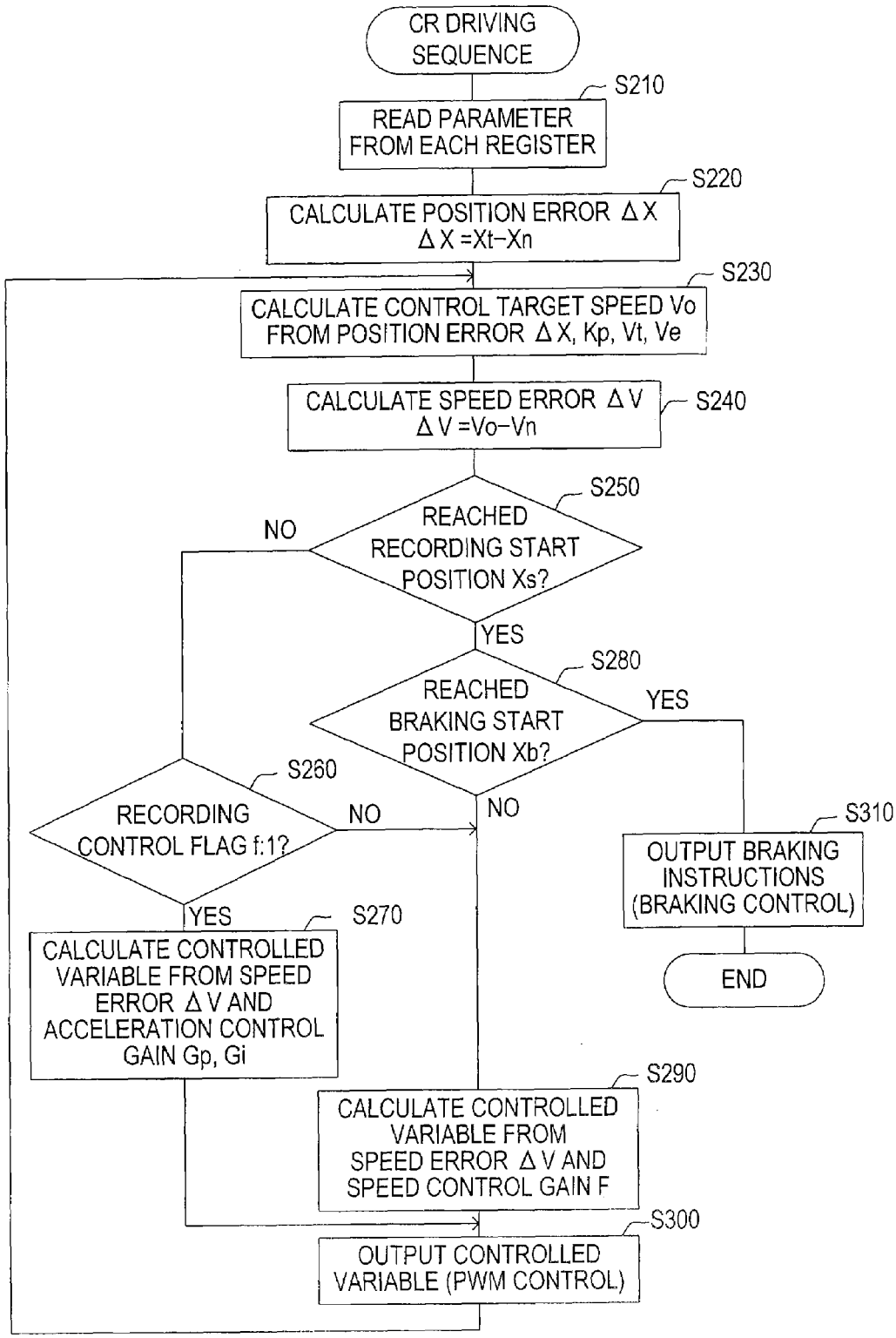
FIG. 8 is a flowchart showing operation sequence of the drive controller shown in FIG. 3.

From now on, explanation on a CR scanning process executed by the CPU 2 so as to operate the driving controller 7 as above, and operation sequence of the driving controller 7, is given by way of flowcharts shown in FIGS. 7 and 8.

Referring to FIG. 7, firstly in the CR scanning process executed by the CPU 2, data for carriage control in the scanning area where the carriage 31 is to be moved (i.e., the section between the current stop position (driving start position) of the carriage 31 and the next target stop position Xt) are read in S110. In S120, it is determined whether the recording operation by the recording head 30 is to be performed in the area.

When it is determined that the recording is to be performed in the next scanning area, the process moves to S130. In S130, "1" is sot to the recording control flag f (f=1) and the process moves to S150. When it is determined that the recording is not to be performed in the next scanning area, the process moves to S140. In S140, the recording control flag f is reset (f=0) and the process moves to S150.

In S150, according to the data read in S110, various parameters, such as the target stop position Xt, for carriage control are written to the respective registers 50 to 58 constituting the register group 5 of the aforementioned ASIC 3. In S160, start settings are written to the start setting register 5*a* in the ASIC 3 so as to start each part of the ASIC 3.

After the ASIC3 is started as above, the process moves to S170. In S170, the CPU 2 stands by until the stop interrupt signal is inputted from the interrupt processor 65 of the ASIC 3. When the stop interrupt signal is inputted, the process is ended.

Among the parameters written to the registers of the register group 5 by the CPU 2, the position control gain Kp written to the register 55 is set so that $Kp \geqq (\alpha/(Xt-Xe))$, where a represents the deceleration degree at the time of deceleration of the CR motor 35, Xe represents the deceleration start position, and Xt represents the target stop position Xt. In other words, the position control gain Kp is set so that the carriage 31 does not start deceleration ahead of the deceleration start position Xe.

When the ASIC 3 is started by the CR scanning process of the CPU 2, the drive controller 7 inside the ASIC 3 is operated in the driving sequence shown in FIG. 8. The driving controller 7 is designed as a hardware circuit to execute the control operation in the driving sequence below. However, in the present embodiment, a flowchart is used for explanation of the operation in order to facilitate understanding.

Referring to FIG. 8, when the driving controller 7 is started to operate, the various parameters for carriage control are read from the respective registers 50 to 58 of the register group 5 in S210. In S220, the position error ΔX between the target stop position Xt and the actual position Xn is calculated through the subtracter 72.

In S230, the control target speed Vo is calculated based on the position error ΔX obtained in 8220, the position control gain Kp, the constant target speed Vt, and the stop target speed Ve through the multiplier 74 and the limiter 76. In S240, the error ΔV between the control target speed Vo and the actual speed Vn is calculated through the subtracter 82.

In S250, it is determined whether the actual position Xn of the carriage 31 has reached the recording start position Xs. If not, the process moves to S260 and determined whether "1" is set to the recording control flag f (f=1). If "1" is set to the recording control flag f (f=1), the process moves to S270 and calculates the driving voltage of the CR motor 35 which is the controlled variable from the speed error ΔV calculated in S240 and the acceleration control gains Gp and Gi through the acceleration controlled variable calculator 86. The process moves to S300.

When it is determined in S250 that the actual position Xn of the carriage 31 has reached the recording start position Xs, the process moves to S280 and it is determined whether the actual position Xn of the carriage 31 has reached the braking start position Xb.

When it is determined in S280 that the actual position Xn of the carriage 31 has not reached the braking start position Xb, or in S260 that "1" is not set to the recording control flag f, the process moves to S290. In S290, the driving voltage of the CR motor 35, which is the controlled variable, is calculated based on the speed variation ΔV calculated in S240 and the speed control gain [F] through the normal controlled variable calculator 84. The process moves to S300.

In S300, the controlled variable (the driving voltage of the CR motor 35) calculated in S270 or in S290 is outputted to the PWM generator 8, where the PWM signal necessary to drive the CR motor 35 at the driving voltage corresponding to the controlled variable is generated. The process returns to S220.

When it is determined in S280 that the actual position Xn of the carriage 31 has reached the braking start position Xb, the process moves to S310. In S310, the brake instructions are outputted to the braking controller 9 and the selector 10 so as to output the braking signal for generating the aforesaid regenerative brake to the CR motor 35 from the braking controller 9 and to select and output the braking signal to the CR driving circuit 4 through the selector 10. The process is then ended.

Figure 9A:
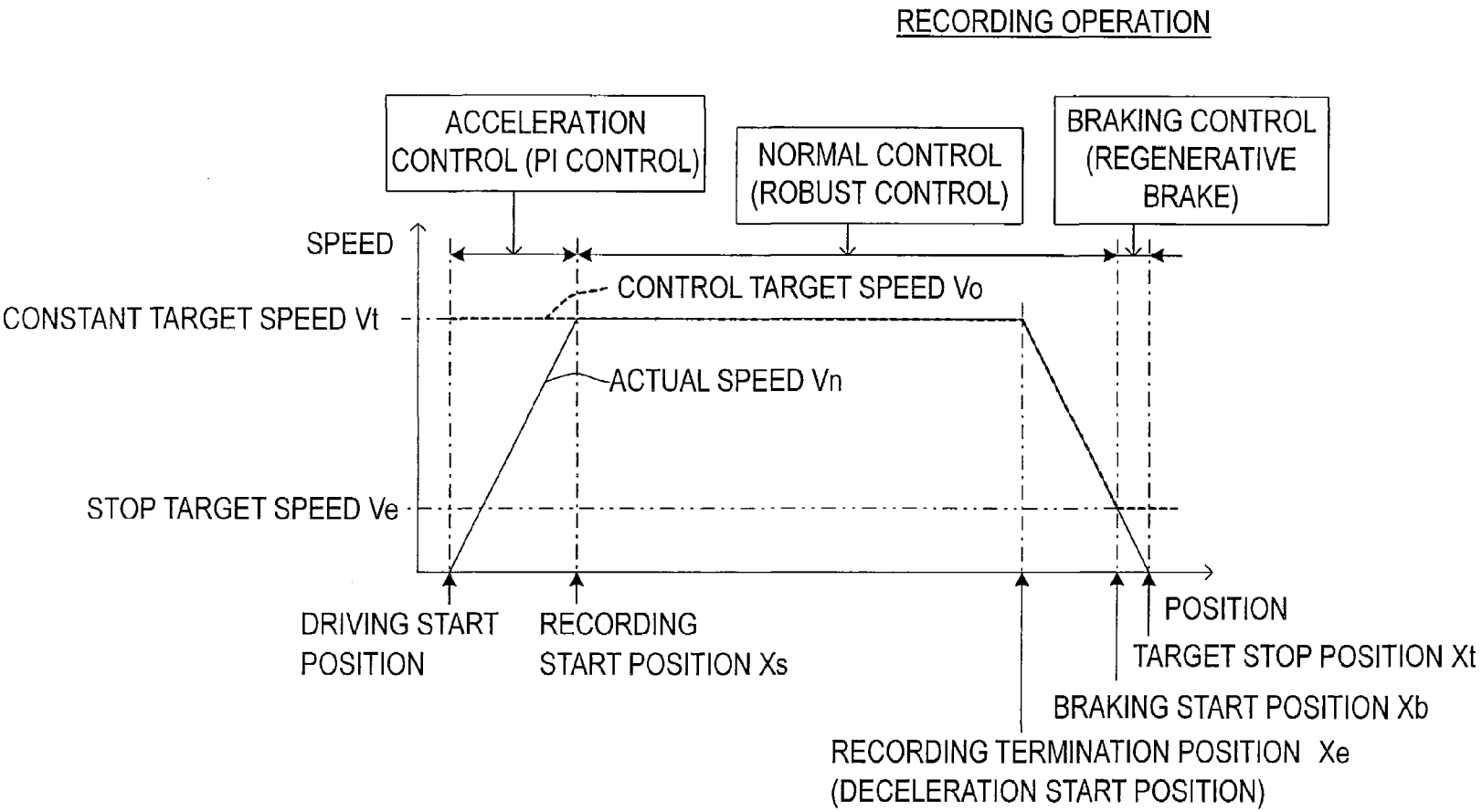
FIGS. 9A and 9B are diagrams showing comparison between control states of the carriage at the time of recording operation and non-recording operation of the printer.

As explained above, in the carriage drive control device of the printer according to the present embodiment, according to the instructions (start settings) from the CPU 2, when the carriage 31 is moved in the main scanning direction, it is determined whether the move is for the recording operation by the recording head 30. When the move of the carriage 31 is for the recording operation by the recording head 30, as shown in FIG. 9A, until the carriage 31 reaches the recording start position Xs, the controlled variable (driving voltage) of the CR motor is calculated according to the control rule of proportional-integral control using the acceleration control gains Gp and Gi for the drive control of the CR motor 35. When the carriage 31 reaches the recording start position Xs, the control rule used for the calculation of the controlled variable is switched to the control rule of robust control using the speed control gain [F] to calculate the controlled variable (driving voltage) of the CR motor 35 for the drive control of the CR motor 35.

Accordingly, at the time of such recording operation, the moving speed of the carriage 31 is converged to the constant target speed without overshooting the constant target speed Vt by the proportional-integral control at the time of acceleration, and then the carriage can be moved to the target stop position while the moving speed of the carriage follows the target speed by the robust control.

Figure 9B:
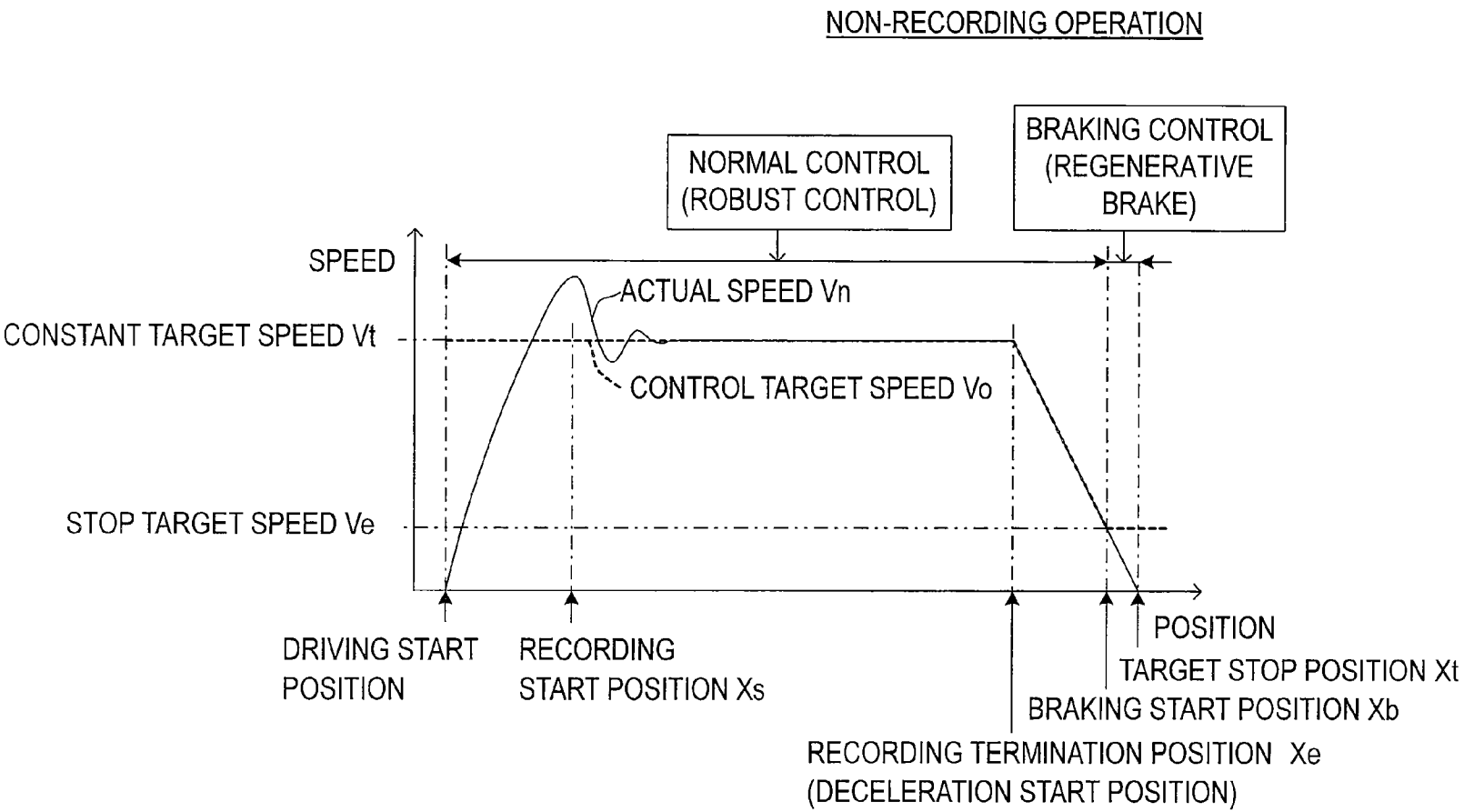

On the other hand, when the move of the carriage 31 is not for the recording operation by the recording head 30, as shown in FIG. 9B, the controlled variable (driving voltage) of the CR motor 35 is calculated according to the control rule of the robust control using the speed control gain [F] in the whole moving area between the driving start position and the target stop position Xt for the drive control of the CR motor 35.

Accordingly, the controlled variable becomes too large in the acceleration section of the carriage 31 where the error between the actual speed Vn of the carriage 31 and the control target speed Vo is increased, and thus the actual speed Vn of the carriage 31 overshoots the control target speed Vo. However, after the actual speed Vn is converged to the control target speed Vo, the moving speed of the carriage 31 follows the target speed by the robust control. Accordingly, the carriage 31 can be moved to the target stop position Xt in a shorter time than the case with the recording operation, while the carriage 31 can be stopped at the target stop position Xt.

Furthermore, in the present embodiment, the minimum value of the control target speed Vo is limited to the stop target speed Ve. Accordingly, when the actual speed Vn of the carriage 31 is off the control target speed Vo and the degree of deceleration of the carriage 31 is larger than normal at the time of deceleration, as shown in FIG. 10A, before the carriage 31 is stopped, the actual speed Vn is controlled to the stop target speed Ve, and then at the time the actual position Xn of the carriage 31 reaches the braking start position Xb, the braking force by the regenerative brake is generated in the CR motor 35 so that the carriage 31 is promptly stopped. Therefore, the carriage drive control device of the present embodiment allows the carriage 31 to be stopped in the vicinity of the target stop position in a shorter time than in the conventional device.

Figure 10B:
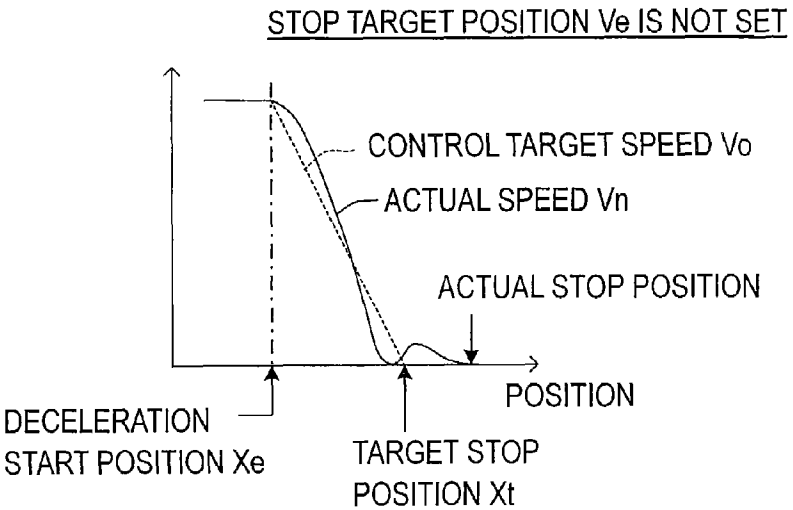
FIGS. 10A and 10B are diagrams illustrating effects obtained by setting a stop target speed to a lower limit of the control target speed in the position controller of FIG. 5.
Figure 10A:
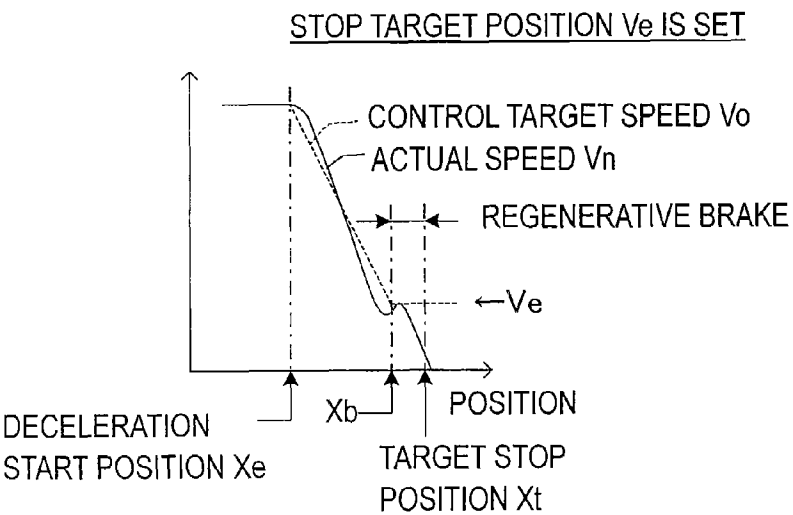

That is, in the conventional carriage drive control device, since the minimum value of the control target speed Vo is not limited as in the present embodiment, when the actual speed Vn of the carriage 31 is off the control target speed Vo and the degree of deceleration of the carriage 81 is larger than normal at the time of deceleration, as shown in FIG. 10B, the carriage 31 is stopped before reaching the target stop position Xt, and then is accelerated again. When the carriage is stopped once and started again, it takes time for the carriage 31 to be released from the static frictional force and start moving. Thus, the time for the carriage 31 to reach the target start position is lengthened. However, in the present embodiment, the carriage 31 can be moved to the target stop position Xt without stopping the carriage 31. Therefore, the carriage 31 can be moved to the target stop position Xt in a shorter time than in the conventional device.

In the above, a preferred embodiment of the present invention is described. However, the present invention is not limited to the above described embodiment, and can be practiced in various manners without departing from the technical scope of the invention.

For instance, the ASIC 3 is used to detect the moving speed and position of the carriage 31, and to generate the PWM signal in the above embodiment. However, for example, a PLD (Programmable Logic Device) may be used instead.

Also, in the above embodiment, the controlled variable is calculated according to the control rule of robust control in the normal controlled variable calculator 84 and according to the control rule of proportional-integral control in the acceleration controlled variable calculator 86. However, only the sensitivity to the speed error ΔV needs be different between the normal controlled variable calculator 84 and the acceleration controlled variable calculator 86. Therefore, the controlled variable may be calculated also according to the control rule of proportional-integral control, or of proportional-integral-derivative control, for example.

What is claimed is:

1. A carriage drive control device in an image forming apparatus that forms an image on a recording medium by moving the recording medium in a sub-scanning direction as well as moving the carriage which mounts a recording head thereon in a main scanning direction, the carriage drive control device moving the carriage in the main scanning direction, and comprising:

an actuator that moves the carriage to and fro in the main scanning direction;

a detector that detects a position and a moving speed of the carriage;

a position controller that sets a target speed based an a position error between a target stop position and a current position of the carriage detected by the detector, the target speed being not more than a predetermined first speed;

a speed controller that calculates a controlled variable of the actuator based on a speed error between the target speed set by the position controller and the moving speed of the carriage detected by the detector;

a driving unit that drives the actuator according to the controlled variable calculated by the speed controller; and a speed control switcher that sets a control rule used for calculation of the controlled variable by the speed controller, the speed control switcher setting a first control rule when the actuator starts moving the carriage for recording operation, the speed control switcher setting second control rule when the actuator starts moving the carriage for non-recording operation.

2. The carriage drive control device according to claim 1, wherein the speed control switcher sets the second control rule when the carriage reaches a recording start position.

3. The carriage drive control device according to claim 2, wherein the position controller sets the target speed not less than a second speed which is higher than a stop speed of the carriage and lower than the first speed.

4. The carriage drive control device according to claim 3, wherein after the carriage starts to decelerate as the actuator is driven according to the controlled variable and the current position of the carriage reaches a braking start position set corresponding to the second speed, the driving unit stops driving the actuator based on the controlled variable so that a braking force is generated in the actuator.

5. The carriage drive control device according to claim 1, wherein the second control rule is more sensitive to the speed error than the first control rule.

6. The carriage drive control device according to claim 1, wherein the first control rule is a control rule of a proportional-integral control system having at least a proportional term and an integral term of the speed error, and the second control rule is a control rule of a robust control system in which parameters are set such that a control target including the carriage and actuator can be robust controlled based on a state equation and an output equation which describes behavior of the control target.

7. The carriage drive control device according to claim 1, wherein the actuator is a CR motor.

8. A carriage drive control method in an image forming apparatus that forms an image on a recording medium by moving the recording medium in a sub-scanning direction as well as moving the carriage which mounts a recording head thereon in a main scanning direction, the carriage drive control method being for moving the carriage in the main scanning direction, and comprising steps of:

setting a target speed based on a position error between a target stop position and a current position of the carriage detected by a detector, the target speed being not more than a predetermined first speed;

calculating a controlled variable of the actuator based on a speed error between the target speed and the moving speed of the carriage detected by the detector;

driving an actuator that moves the carriage to and fro in the main scanning direction according to the calculated controlled variable; and setting a first control rule when the actuator starts moving the carriage for recording operation, or setting a second control rule when the actuator starts moving the carriage for non-recording operation.

9. The carriage drive control method according to claim 8, further comprising the step of setting the second control rule when the carriage reaches a recording start position.

10. The carriage drive control method according to claim 9, wherein the target speed is set not less than a second speed which is higher than a stop speed of the carriage and lower than the first speed.

11. The carriage drive control method according to claim 10, further comprising the step of stopping drive of the actuator based on the controlled variable so that a braking force is generated in the actuator when the current position of the carriage reaches a braking start position set corresponding to the second speed after the carriage starts to decelerate as the actuator is driven according to the controlled variable.

12. The carriage drive control method according to claim 8, wherein the second control rule is more sensitive to the speed error than the first control rule.

13. The carriage drive control method according to claim 8, wherein the first control rule is a control rule of a proportional-integral control system having at least a proportional term and an integral term of the speed error, and the second control rule is a control rule of a robust control system in which parameters are set such that a control target including the carriage and actuator can be robust controlled based on a state equation and an output equation which describes behavior of the control target.

* * * * *